US005448793A

United States Patent [19]

Mallory et al.

[11] Patent Number: 5,448,793

[45] Date of Patent: Sep. 12, 1995

[54] WINDOW CLEANING DEVICE

[75] Inventors: George T. Mallory, Blenheim; Richard McFadden; Gary Stover, both of Chatham; Robert L. Smith, Charing Cross, all of Canada

[73] Assignee: Mallory Industries, Inc., Blenheim, Canada

[21] Appl. No.: 285,077

[22] Filed: Aug. 3, 1994

Related U.S. Application Data

[63] Continuation of Ser. No. 116,630, Sep. 7, 1993, abandoned, and a continuation-in-part of Ser. No. 150,233, Nov. 5, 1993, Pat. No. 5,371,914, which is a continuation of Ser. No. 851,731, Mar. 16, 1992, abandoned, said Ser. No. 116,630, is a continuation-in-part of Ser. No. 851,731, Mar. 16, 1992.

[51] Int. Cl.[6] ..... A47L 1/08

[52] U.S. Cl. ..... 15/232; 15/121; 15/244.1

[58] Field of Search ..... 15/244.1, 118, 121, 15/232

[56] References Cited

U.S. PATENT DOCUMENTS

| | | | |
|---|---|---|---|
| 684,592 | 10/1901 | Trost . | |
| 1,021,161 | 3/1912 | O'Connell . | |
| 1,607,371 | 11/1926 | Summer . | |
| 2,011,975 | 8/1935 | Johnson | 15/231 |
| 2,229,147 | 1/1941 | Vaughn | 15/244 |
| 2,231,234 | 2/1941 | Weil | 15/244 |
| 2,745,126 | 5/1956 | Mora | 15/121 |
| 2,915,768 | 12/1959 | Hall | 15/244.1 |
| 3,353,203 | 11/1967 | Ginter | 15/244.1 |
| 3,366,988 | 2/1968 | Menkin | 15/244.1 |
| 3,406,420 | 10/1968 | Siemund | 15/121 |
| 3,724,017 | 4/1973 | Mallory | 15/121 |
| 3,783,469 | 1/1974 | Siemund | 15/121 X |
| 4,050,111 | 9/1977 | Mallory | 15/244.1 X |
| 4,155,139 | 5/1979 | Corcoran | 15/244.1 |
| 4,609,301 | 9/1986 | Benarrouch | 15/244.1 X |
| 4,856,136 | 8/1989 | Janssen | 15/244.1 X |

FOREIGN PATENT DOCUMENTS

| | | | |
|---|---|---|---|
| 584387 | 10/1959 | Canada . | |
| 0074525 | 3/1983 | European Pat. Off. | 15/121 |
| 333543 | 7/1903 | France | 15/244.1 |
| 017656 | 10/1913 | France | 15/147.2 |
| 609710 | 2/1935 | Germany | 15/244.2 |

*Primary Examiner*—Christopher K. Moore
*Attorney, Agent, or Firm*—Cohn, Powell & Hind

[57] ABSTRACT

A window cleaning device of the type having a handle, a head attached to the handle and a sponge mounted in a longitudinal channel in the head of the washer is provided. A net-like web envelops the sponge. The cleaning device includes an improved stiffener having an elongate body provided with a pair of shoulders extending along the body on both sides thereof. A plurality of protrusions are integrally formed with and extend outwardly from the shoulders on both sides of the elongate body. The stiffener has a pair of flanges one located at each end of the elongate body for locating the body in the channel and preventing movement of the body in the channel. The protrusions act to compress multiple portions of the sponge between the ends of protrusions and the channel walls which creates a plurality of highly compressed areas at these points adjacent less compressed areas between the highly compressed areas into which excess sponge can flow. The action of the protrusions to grip the sponge on the interior thereof provides a firm anchor so that the sponge cannot be removed except by dislodging the stiffener from the channel. At the highly compressed areas portions of the sponge are forced through the perforations in the web thereby creating a locking effect between the sponge and web, similar to a peg through a hole, which provides increased gripping strength. The stiffener is injected molded from plastic.

12 Claims, 2 Drawing Sheets

FIG. 3
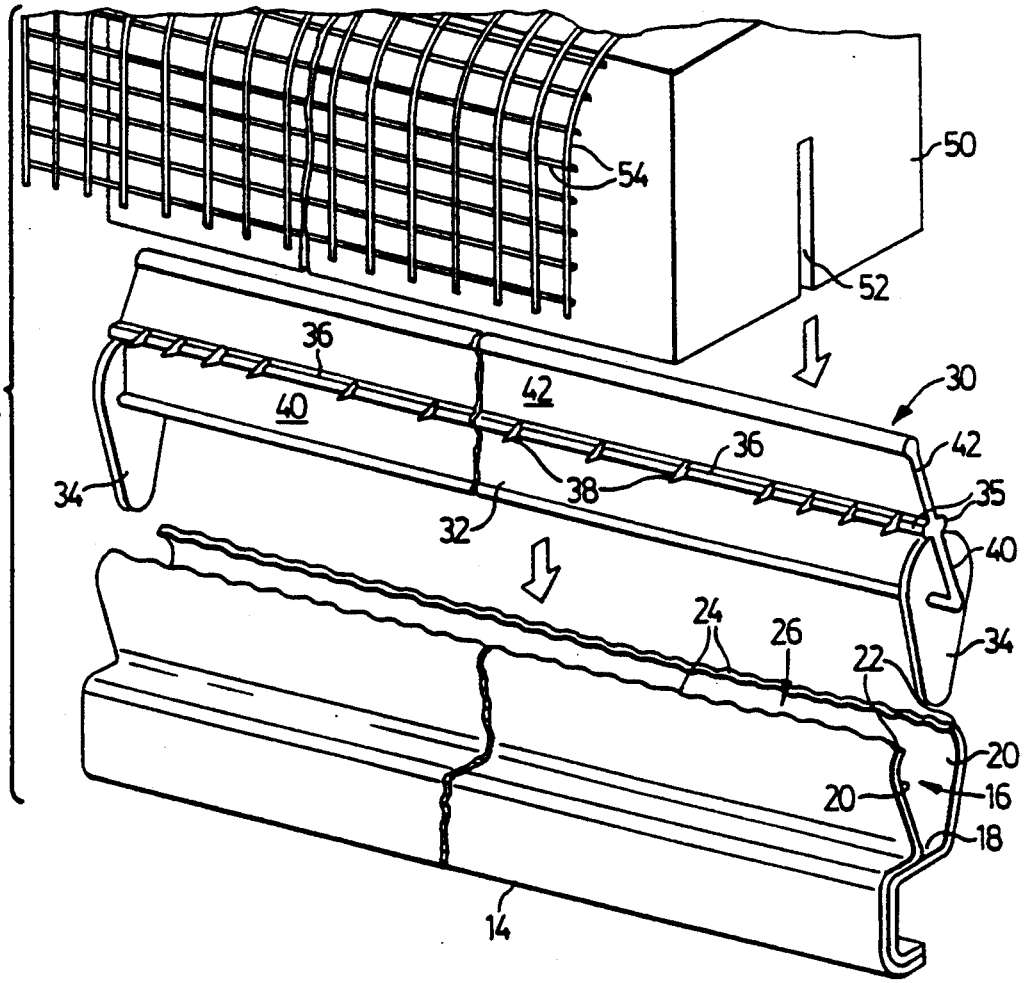
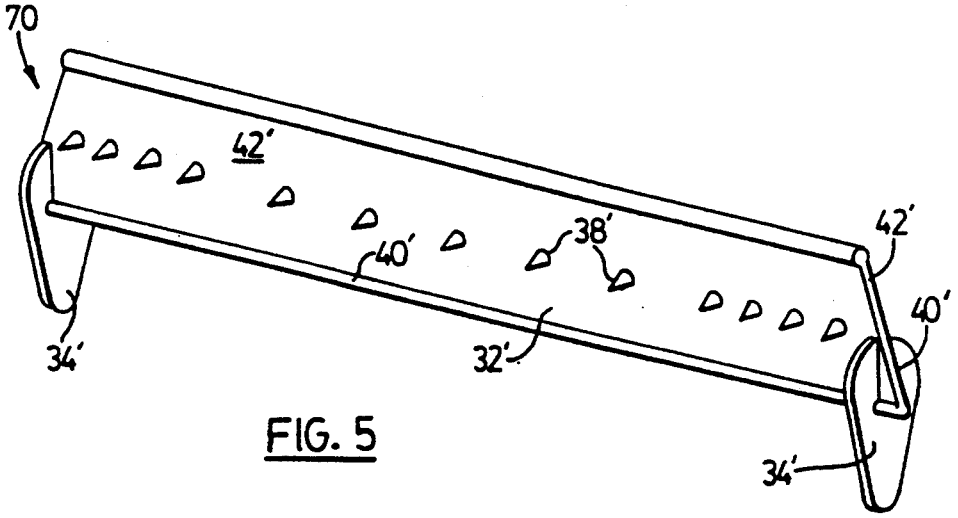
FIG. 5

WINDOW CLEANING DEVICE

This is a continuation of application Ser. No. 08/116,630, filed on Sept. 7, 1993, which is a continuation in part of Ser. No. 07/851,731 filed Mar. 16, 1992, now abandoned.

FIELD OF THE INVENTION

The present invention relates to window washing devices.

BACKGROUND OF THE INVENTION

The present window cleaning device is related to the inventions described in earlier U.S. Pat. No. 3,724,017 dated Apr. 3, 1973, and U.S. Pat. No. 4,050,111 dated Sep. 27, 1977. The earlier invention provided a net-like web enveloping the cleaning sponge. The presence of the net enveloping the sponge enhances the cleaning properties of the window washer since the net acts as a scrapper. However, the presence of the net increased the difficulty of securely clamping the sponge to the washer head since as the web encounters surface irregularities and obstructions, a considerable pulling force is exerted on the net which acts to pull the net and sponge out of the channel in which it is mounted. The later invention provided a more secure mount for the sponge and net by providing a pair of continuous shoulders on the sponge stiffener so that the sponge and net was compressed between the shoulders and the side walls of the channel in which the sponge is mounted.

A drawback to this mounting arrangement is that there is a strong tendency for the net and sponge to be pulled out of the channel near the ends thereof due to the ends of the sponge and net getting caught on the windshield washers or on pieces of trim. Accordingly, it would be advantageous to provide a sponge and net mount assembly which more strongly anchors the ends of the sponge and net to the window cleaner head.

SUMMARY OF THE INVENTION

In one aspect of the invention there is provided a window cleaning device of the type having a handle, a head mounted on the handle and the head has a longitudinally elongated channel formed therein. The channel has an inner wall and opposed side walls with the opposed, spaced side walls defining a nominal channel width. Each of the side walls is provided with a flange projecting inwardly therefrom to form a narrow passage therebetween. Included is a longitudinally elongated sponge having a longitudinally extending mounting portion and a longitudinally extending wiping portion. The mounting portion is mountable within the channel to secure the sponge to the head. Included is a stiffener comprising a stiff, elongate body having opposed sides and a pair of shoulders having opposed sides. The shoulders extend longitudinally of the elongate body with a first shoulder of the pair projecting outwardly from one side of the elongate body and a second shoulder of the pair projecting outwardly from the other side of the elongate body. The shoulders divide the elongate body in the lateral direction into a spacer web on one side of the shoulders and a stiffener web on the other side thereof. The mounting portion of the sponge is deformable to deform around the stiffener. The improvement comprises the stiffener member having a plurality of sharp protrusions spaced longitudinally along the body and projecting transversely outwardly from the shoulders. The protrusions have a combined transverse length which is greater than the nominal width of the elongated channel. When the sponge, stiffener and head are assembled, the sponge mounting portion is deformed around the stiffener with the protrusions disposed within the channel so that the spacer web projects into engagement with the inner wall of the channel to prevent movement of the protrusions inwardly with respect to the channel. The side walls are deflected away from each other so that the width of the channel becomes the combined transverse length of the protrusions and the compressed sponge into which the protrusions sink which is greater than the nominal width such that the sponge is highly compressed and tightly clamped between the protrusions and the side walls of the channel. The stiffener web projects outwardly from the channel into the wiping portion of the sponge to stiffen the wiping portions of the sponge.

BRIEF DESCRIPTION OF THE DRAWINGS

The following is a description, by way of example only, of an embodiment of the window cleaning device of the present invention, references being had to the accompanying drawings, in which:

FIG. 3 is a perspective view of the window washing device of FIG. 1 in disassembled form showing one embodiment of a stiffener forming part of the subject invention;

FIG. 5 is a perspective view of another embodiment of a stiffener forming part of the subject invention.

DETAILED DESCRIPTION OF THE PREFERRED EMBODIMENT

Figure 1:
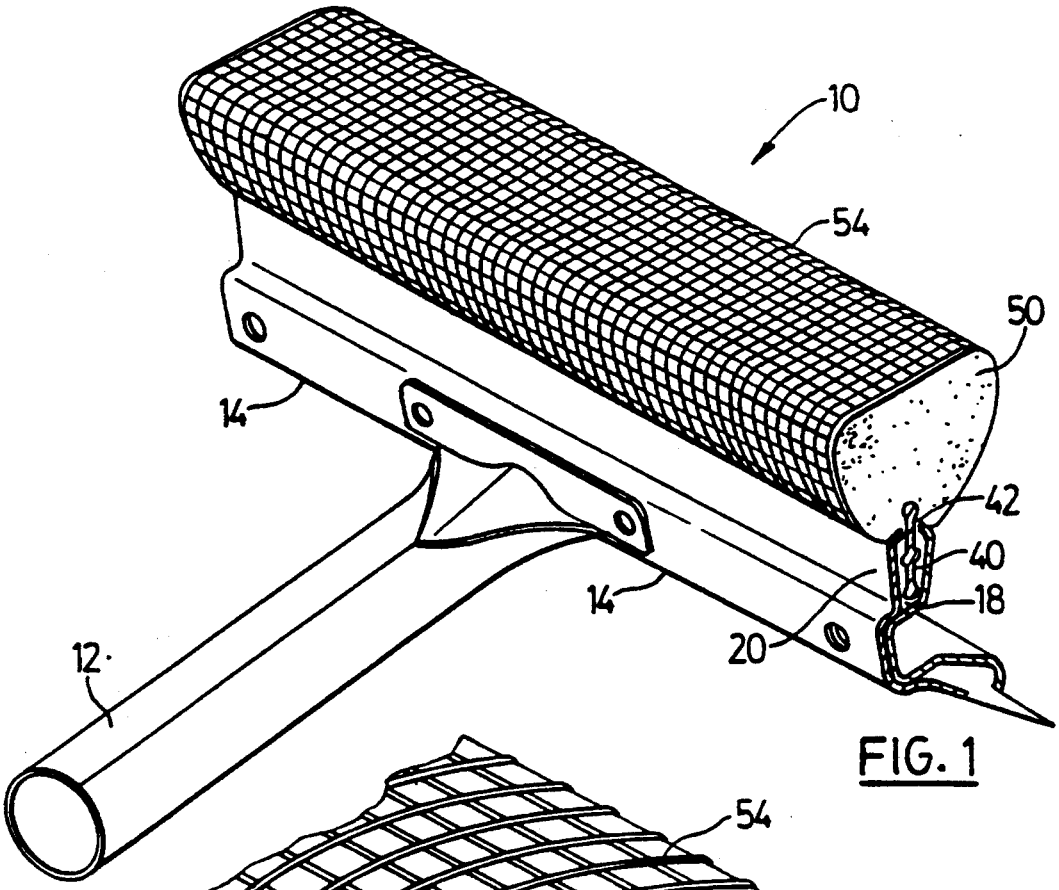
FIG. 1 is perspective view, of a window cleaning device embodying the subject invention.
Figure 2:
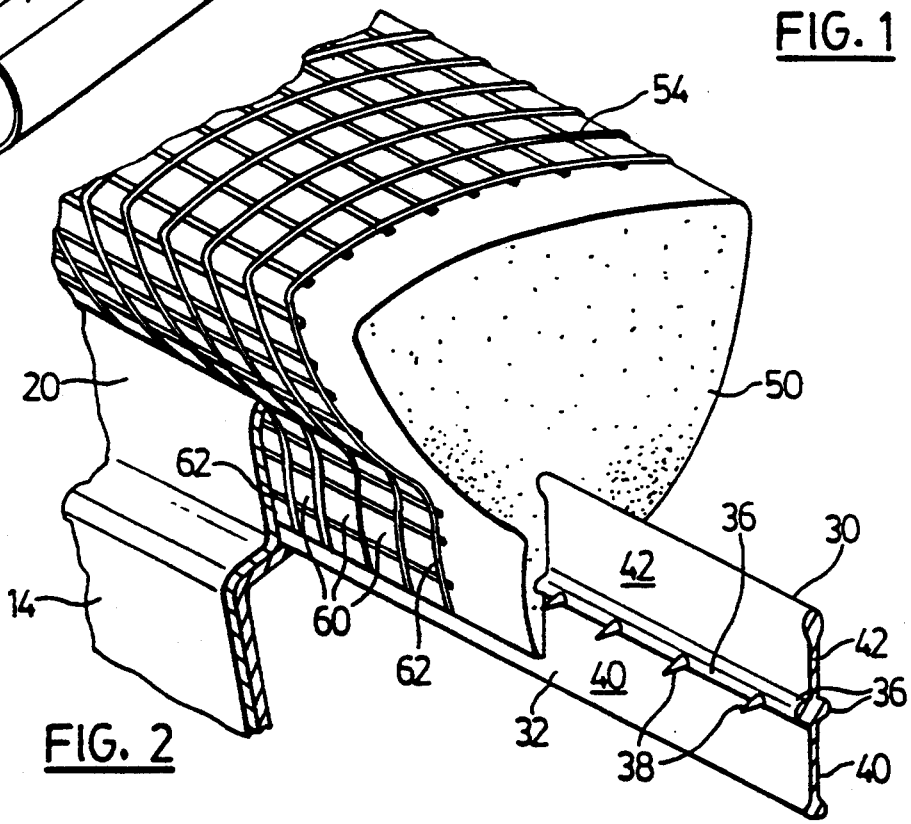
FIG. 2 is a three dimensional cut-away of FIG. 1.

Referring to FIGS. 1 to 3, there is shown a window cleaner 10 having a handle 12 and a head 14 mounted on handle 12. Head 14 is formed to include an elongate channel 16 bounded by an inner wall 18, spaced, opposed sidewalls 20 and a pair of flanges 22 which extend inwardly from the outer peripheral edges of side walls 20. The inner facing edges of flanges 22 include serrations 24. A passage 26 is located between serrated edges of flanges 22.

Window cleaner 10 is provided with a stiffener member 30 having an elongate body 32 extending in a longitudinal direction. Stiffener 30 is provided with end flanges 34 attached generally at the ends of body 32. Stiffener 30 also includes a pair of shoulders 36 projecting transversely outwardly from the sides of elongate body 32 and being integrally formed with body 32. Stiffener 30 is provided with a plurality of spaced teeth or sharp protrusions 38 integrally formed with shoulders 36 and projecting outwardly therefrom. Protrusions 38 are of sufficient sharpness to grip a sponge material. Protrusions 38 are non-uniformly distributed along shoulders 36, being more closely spaced at the ends of body 32 than in the middle portion thereof. Protrusions 38 have a combined transverse extension which is greater than the width of passage 26 and the width of channel 16 between side walls 20 prior to assembly of the sponge 50 and stiffener 30 with head 14.

Stiffener 30 is divided in the lateral direction into a spacer web 40 extending downwardly from shoulders 36 along the length of body 32 and a stiffener web 42 projecting upwardly from shoulders 36 along the length of body 32, best seen in FIG. 3. Spacer web 40 is of a suitable length so that when stiffener 30 is located in channel 16 the outer peripheral edge of spacer web 40 rests on the inner wall 18 and protrusions 38 are located in channel 16 below flanges 22. Similarly, stiffener web 42 is of sufficient length that it extends between flanges 22 into the body of a sponge, see FIG. 3.

Stiffener 30 is preferably fabricated of a suitable plastic, wherein body 32, shoulders 36 and protrusions 38 are molded or injection molded and integrally formed as a unitary structure.

Window washer 10 includes a sponge 50 and in the embodiment shown in FIG. 3 sponge 50 is provided with a slit 52 located in a mounting portion of sponge 50 which acts to receive stiffener web 42 and a portion of spacer web 40, more clearly seen in FIG. 2. A web of net-like material 54 extends over the outer surface of a wiping portion of sponge 50.

Referring again to FIGS. 1 and 2, when window washer 10 is assembled the mounting portion of sponge 50 adjacent slit 52 and web 54 envelops stiffener web 42 and is secured in channel 16 by being clamped between walls 20 and the outer ends of protrusions 38. Because protrusions 38 have a combined transverse length which is greater than the width of channel 16 between side walls 20 prior to assembly, when the wiper is assembled with sponge 50 and stiffener 30, walls 20 of channel 16 are deflected outwardly so that the channel width becomes the combined size of protrusions 38 and the compressed sponge portion into which the protrusions sink. The ensuing spring action of walls 20 inwardly causes lateral pressure on sponge 50 and stiffener 30 (particularly in the vicinity of protrusions 38) and causes aggressive gripping action by serrations 24 on flanges 22. Walls 20 can be deflected away from each other when the cleaning device is assembled but they are not deformable. In this way, they strongly compress the sponge, web within the head to permanently grip the sponge.

Figure 4:
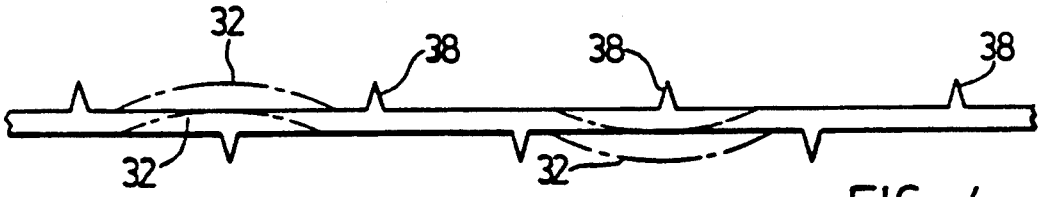
FIG. 4 is a plan view, broken away, of the stiffener shown in FIG. 3.

The plan view shown in FIG. 4 of the stiffener of FIG. 3 shows the protrusions being staggered on either side of body 32. This staggered arrangement facilitates flexing of the stiffener (shown in broken lines) after assembly of the sponge, stiffener and head 14 when the stiffener is located in head 14 between walls 20 thereby avoiding further outward deflection of walls 20. This staggered arrangement also increases the probability that the apertures of web 54 are engaged by portions of the sponge adjacent the protrusions. In addition, the flexing of stiffener 30 along its length thereof contributes to increasing the bond between sponge 50 and head 14 by providing periodic, reduced gaps between the two sides of the stiffener and walls 20. Flanges 34 are located on the outside of channel 16 and act to locate body 32 in channel 16 and prevent movement of body 32 in channel 16. Protrusions 38 protrude into and are anchored in sponge 50. The plurality of protrusions 38 act to compress multiple portions of sponge between the ends of teeth 38 and walls 22 which creates a plurality of highly compressed sponge areas 60 at these points which are adjacent to less compressed sponge areas 62 into which excess sponge material can flow, see FIG. 2. The sponge at areas 60 is under high pressure between protrusions 38 and wall 20 and is therefore tightly clamped therebetween. The action of protrusions 38 gripping sponge 50 on the interior thereof is to provide a firm anchor so that sponge 50 cannot be removed except by dislodging stiffener 30 from channel 16. This sponge retaining arrangement has been found to be superior to the elongate shoulders in the prior art. Further, at the highly compressed areas 60, portions of sponge 50 are forced through the perforations in web 54 thereby producing a positive lock between the sponge and web, similar to a peg through a hole, which provides increased interlock between sponge 50 and net 54. Protrusions 38 force sponge 50 and web 54 to contort around protrusions 38 as well as around serrations 24 thereby binding sponge 50 and web 54 in place. It has been found that the retention of the combination of net 54 and sponge 50 to head 14 is dramatically improved by use of protrusions 38.

The more closely spaced protrusions along the end portions of body 32 provide a stronger grip for gripping the sponge and web at the ends of head 14 where the sponge and web have a greater probability of being caught and pulled during use. The more widely spaced protrusions in the central region provide for greater ease in handling of stiffener 30 prior to the latter being incorporated into head 14.

Referring to FIG. 5, another embodiment of a stiffener 70 embodying the subject inventions is shown and is similar to stiffener 30 illustrated in FIG. 3 except stiffener 70 is fabricated absent shoulders 36 wherein protrusions 38′ are attached directly to and extend outwardly from elongate body 32′. The longitudinal line of protrusions 38′ divide stiffener 70 into a spacer web 40′ and a stiffener web 42′. In this embodiment protrusions 38′ have a combined transverse extension which is greater than the width of passage 26.

It will be appreciated by those skilled in the art that stiffeners 30 or 70 forming part of the invention disclosed herein may also be retrofitted into modular window washers comprised of components which can be readily assembled and disassembled. In addition, the stiffener disclosed herein may be used on window washing devices absent the web.

While the window washer of the present invention has been described and illustrated with respect to the preferred embodiment, it will be appreciated that numerous variations of these embodiments may be made without departing from the scope of the invention described herein.

What is claimed is:

1. In a window cleaning device of the type having a handle, a head mounted on the handle, the head having a longitudinally elongated channel formed therein, the channel having an inner wall and spaced opposed side walls defining a nominal channel width, each of the side walls provided with a flange projecting inwardly therefrom to form a narrow passage therebetween, a longitudinally elongated sponge having a longitudinally extending mounting portion and a longitudinally extending wiping portion, the mounting portion being mountable within said channel to secure the sponge to the head, a stiffener comprising a stiff, elongate body having opposed sides and a pair of shoulders having opposed sides, said shoulders extending longitudinally of the elongate body with a first shoulder of said pair of shoulders projecting outwardly from one side of said elongate body and a second should of said pair of shoulders projecting outwardly from the other side of said elongate body, the shoulders dividing the elongate body in a lateral direction into a spacer web on one side of the shoulders and a stiffener web on the other side thereof, the mounting portion of the sponge being deformable to deform around the stiffener, said side walls defining a means to highly compress and clamp said mounting portions in said channel the improvement of the stiffener member comprising:

a) a plurality of sharp protrusions spaced longitudinally along the body and projecting transversely outwardly from said shoulders and wherein the protrusions are non-uniformly spaced along the elongate body, the protrusions being more closely spaced along the end portions of the body than in the middle portion of the body;

b) the protrusions having a combined transverse length which is greater than the narrow passage of the elongated channel; and c) such that when the sponge, stiffener and head are assembled, the sponge mounting portion is deformed around the stiffener with said protrusions disposed within said channel so that the spacer web projects into engagement with the inner wall of the channel to prevent movement of the protrusions inwardly with respect to the channel, and the sponge mounting portion is highly compressed and tightly clamped between the protrusions and the side walls of the channel, said stiffener web projecting outwardly from said channel into the wiping portion of the sponge to stiffen the wiping portion of the sponge.

2. A window cleaning device according to claim 1 wherein the protrusions on one side of the elongate body are staggered in the longitudinal direction with respect to the protrusions on the other side of the elongate body.

3. A window cleaning device according to claim 2 including a pair of flanges attached one at substantially each end of said elongate body.

4. A window cleaning device according to claim 3 wherein the body, protrusions, flanges and the shoulders are molded from a suitable plastic and are of unitary construction.

5. A window cleaning device according to claim 2 wherein the body, protrusions and the shoulders are molded from suitable plastic and are of unitary construction.

6. A window cleaning device according to claim 3 including a web-like net enveloping the sponge and having a portion located in the channel being compressed between the mounting portion of the sponge and said inner side walls in such a way that portions of the sponge is forced through apertures in the net to provide a positive lock between the sponge and the web-like net.

7. A stiffener for use in window washing devices of the type having a handle, a head mounted on the handle, the head having at least a longitudinally elongated channel formed therein, the channel having opposed side walls, an elongated sponge having a longitudinally extending mounting portion and a longitudinally extending wiping portion, said mounting portion of said sponge being deformable around said stiffener and also the mounting portion being mountable within said channel to secure the sponge to the head; said stiffener comprising:

an elongated body extending in a longitudinal direction and fabricated of stiff material, the elongate body provided with a plurality of protrusions spaced longitudinally along the body and projecting transversely outwardly therefrom, wherein the protrusions are non-uniformly spaced along the elongate body, the protrusions being more closely spaced along the end portions of the body than in the middle portion of the body; wherein when said mounting operation of said sponge is mounted within said channel, said protrusions are disposed in said channel.

8. A stiffener according to claim 7 wherein the protrusions on one side of the stiffener are staggered in the longitudinal direction with respect to the protrusions on the other side of the stiffener.

9. A stiffener according to claim 7 wherein said elongate body is provided with a pair of shoulders extending longitudinally of the body and projecting outwardly from opposite sides of the body, the protrusions being attached to said shoulders and being spaced longitudinally therealong.

10. A stiffener according to claim 9 wherein the protrusions on one side of the stiffener are staggered in the longitudinal direction with respect to the protrusions on the other side of the stiffener.

11. A stiffener according to claim 10 including a pair of flanges attached one at substantially each end of said elongate body.

12. A stiffener according to claim 11 wherein the elongate body, protrusions, flanges and the shoulders are molded from a suitable plastic and are of unitary construction.

* * * * *

UNITED STATES PATENT AND TRADEMARK OFFICE

CERTIFICATE OF CORRECTION

PATENT NO. : 5,448,793

DATED : 12 September 1995

INVENTOR(S) : Mallory et al.

It is certified that error appears in the above-identified patent and that said Letters Patent is hereby corrected as shown below:

Column 4, line 64, delete "should" and insert --shoulder--.

Column 5, line 43, after "from" insert --a--.

Column 5, line 45, delete "3" and insert --2--.

Column 6, line 24, delete "operation" and insert --portion--.

Signed and Sealed this

Thirtieth Day of April, 1996

Bruce Lehman

*Attest:*

BRUCE LEHMAN

*Attesting Officer*

*Commissioner of Patents and Trademarks*